United States Patent [19]

Tanaka et al.

[11] Patent Number: 4,637,233

[45] Date of Patent: Jan. 20, 1987

[54] BEAM FOR A DYEING APPARATUS

[75] Inventors: Takashi Tanaka, Kurobe; Satoru Yamamoto, Toyama, both of Japan

[73] Assignee: Yoshida Kogyo K. K., Tokyo, Japan

[21] Appl. No.: 628,894

[22] Filed: Jul. 9, 1984

[30] Foreign Application Priority Data

Jul. 9, 1983 [JP] Japan ..... 58-106756[U]

[51] Int. Cl.[4] ..... D06B 5/18

[52] U.S. Cl. ..... 68/198; 242/118.1

[58] Field of Search ..... 68/189, 198; 242/118.1, 242/118.11

[56] References Cited

U.S. PATENT DOCUMENTS

| | | | |
|---|---|---|---|
| 1,404,634 | 1/1922 | Morton | 68/198 |
| 2,191,108 | 2/1940 | Huttinger | 68/189 X |
| 2,250,085 | 7/1941 | Stienen | 68/189 |
| 2,594,366 | 4/1952 | Stienen | 68/198 X |
| 2,671,332 | 3/1954 | Zingg | 68/198 |
| 3,181,251 | 5/1965 | Ege et al. | 242/118.1 |
| 3,217,386 | 11/1965 | Clendening, Jr. | 68/189 X |
| 3,433,432 | 3/1969 | Willis | 242/118.1 |
| 4,180,880 | 1/1980 | Stritzko | 68/198 X |
| 4,454,733 | 6/1984 | Fukuroi | 68/198 |

FOREIGN PATENT DOCUMENTS

| | | | |
|---|---|---|---|
| 43-14646 | 6/1968 | Japan . | |
| 1093307 | 11/1967 | United Kingdom | 68/212 |

*Primary Examiner*—Timothy F. Simone
*Assistant Examiner*—Frankie L. Stinson
*Attorney, Agent, or Firm*—Hill, Van Santen, Steadman & Simpson

[57] ABSTRACT

A beam for a dyeing apparatus comprises a pair of concentric inner and outer tubes, each having a multiplicity of peripheral holes therethrough. A net of a heat- and corrosion-resistant material is wound on the outer tube for supporting materials (to be treated) thereon to keep the materials from being marked with traces of the holes in or any projections on the outer tube. The meshes of the net are smaller in size and larger in number per unit area than the outer tube's holes, which are in turn smaller in size and larger in number per unit area than the inner tube's holes, making the liquid flow uniform and hence suitable to penetrate uniformly throughout the materials.

5 Claims, 5 Drawing Figures

BEAM FOR A DYEING APPARATUS

BACKGROUND OF THE INVENTION

1. Field of the Invention

The present invention relates to dyeing apparatus, and more particularly to a beam for winding thereon materials, such as textiles, to be treated with dyeing liquid in such apparatus.

2. Prior Art

Dyeing apparatus is known which has a hollow perforated beam for winding thereon textile materials, such as tapes woven or knit of yarns at least partially including synthetic fibers, to be treated with dyeing liquid. A common problem with the known apparatus is that because of the thermoplatic characteristics of such textile materials, the materials would shrink to a considerable extent to become tightened firmly over the holes in the periphery of the beam due to high temperature and high pressure during dyeing, causing non-smooth flow of the dyeing liquid, which would result in non-uniform treatment of the roll of the textile materials with different shades and hues both radially and axially of the roll.

To eliminate such uneven treatment, it has been proposed, as disclosed in Japanese Patent Publication (Kokoku) No. 43-14646, to cover the periphery of a hollow perforated tube with a cushion of polyurethane foam, knit cloth or Japanese paper for winding thereon the textile materials. The cushion not only serves to absorb the extent to which the textile materials shrink due to heat, but also serves to equalize the liquid flow. However, the cushion must be replaced with a new one upon each and every use, making the operation of the prior apparatus time-consuming and expensive. Also the used cushions must be disposed of with careful attention from a view point of protection against environmental pollution.

SUMMARY OF THE INVENTION

According to the present invention, a beam comprises a pair of concentric inner and outer tubes, each having a multiplicity of peripheral holes therethrough. A net of a heat- and corrosion-resistant material is wound on the outer tube for supporting materials (to be treated) thereon to keep the materials from being marked with traces of the holes in or any projection on the outer tube. The meshes of the net are smaller in size and larger in number per unit area than the outer tube's holes, which are in turn smaller in size and larger in number per unit area than the inner tube's holes, making the liquid flow uniform and hence suitable to penetrate uniformly throughout the materials.

It is therefore an object of the present invention to provide a beam, for a dyeing apparatus, with which a roll of textile materials on the beam can be treated uniformly without creation of different shades and hues either radially or axially of the roll.

Another object of the invention is to provide a beam, for a dyeing apparatus, by which a roll of textile materials can be supported without being marked with unsightly traces of any hole in or projection on a perforated tube during dyeing.

Still another object of the invention is to provide a beam, for a dyeing apparatus, with which dyeing operation can be carried out without the troublesome disposal of any waste parts.

Many other advantages, features and additional objects of the present invention will become manifest to those versed in the art upon making reference to the detailed description and the accompanying drawings in which a preferred embodiment incorporating the principles of the present invention is shown by way of illustrative example.

DETAILED DESCRIPTION

Figure 1:
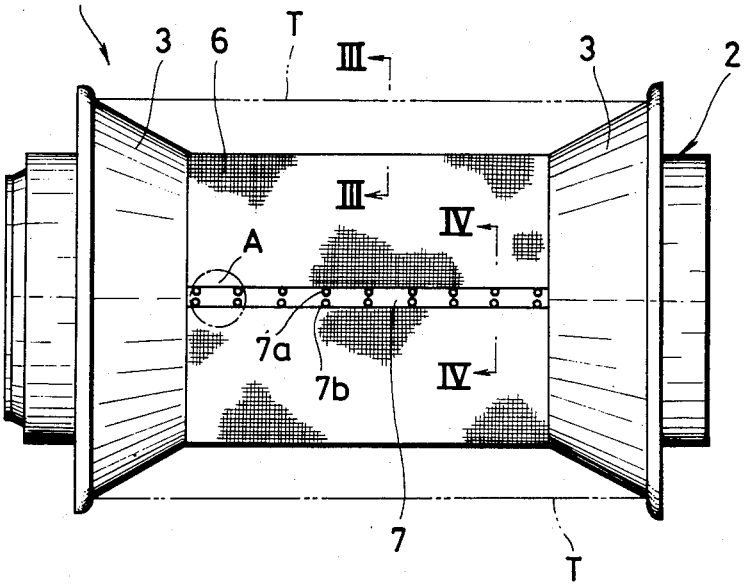
FIG. 1 is a front elevational view of a beam, for use in a dyeing apparatus, embodying the present invention.

FIG. 1 shows a beam 1 adapted to be horionztally mounted within a dyeing apparatus (not shown). The beam 1 comprises a cylindrical body 2 for winding thereon elongate textile materials T, such as slide fastener stringer tapes, to be treated with dyeing liquid. The cylindrical body 2 has near opposite ends thereof a pair of opposed frustoconical flanges 3, 3.

Figure 2:
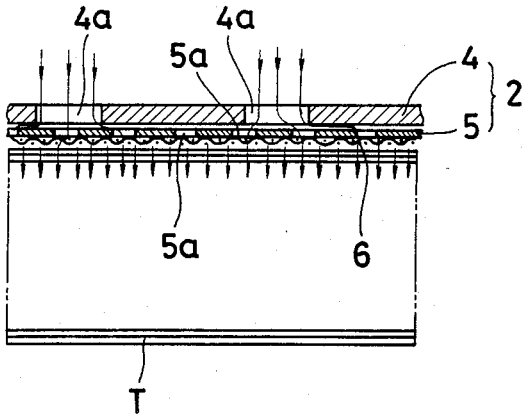
FIG. 2 is a fragmentary enlarged longitudinal cross-sectional view of the beam, illustrating the manner in which dyeing liquid flows during dyeing.
Figure 3:
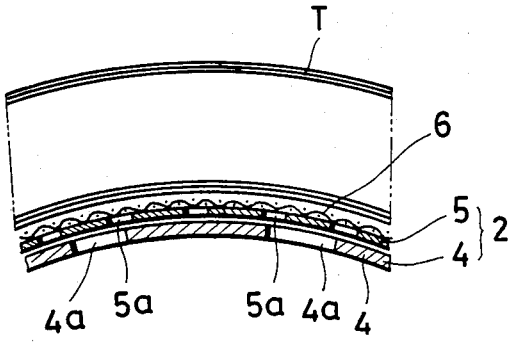
FIG. 3 is a fragmentary enlarged cross-sectional view taken along line III—III of FIG. 1.
Figure 4:
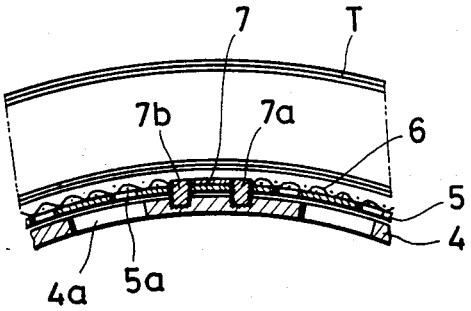
FIG. 4 is a fragmentary enlarged cross-sectional view taken along line IV—IV of FIG. 1.

As shown in FIGS. 2, 3 and 4, the cylindrical body 2 includes a pair of concentric inner and outer tubes 4, 5 joined together in radially spaced relation and having a multiplicity of first peripheral holes 4*a* and a multiplicity of second peripheral holes 5*a*, respectively. The second holes 5*a* of the outer tube 5 are smaller in size and larger in number per unit area than the first holes 4*a* of the inner tube 4; that is, the distribution density of the second holes 5*a* is higher than that of the first holes 4*a*, for a purpose described below.

A net 6 is wound on the periphery of the outer tube 5 and extends between the opposed flanges 3, 3. As better shown in FIG. 5, the net 6 has a multiplicity of meshes 6*b* defined by a plurality of wires 6*a* uniformly woven in plain weave. The wires 6*a* are made of a material that is resistant to heat and corrosion so as not to contaminate the dyeing liquid, the material comprising preferably stainless steel. If the dyeing liquid were contaminated, the roll of the textile materials T on the net 6 would be treated so as to result in different shades and hues both radially and axially of the roll.

The meshes 6*b* of the net 6 are smaller in size and larger in number per unit area than the second holes 5*a* of the outer tube 5; that is, the distribution density of the meshes 6*b* is higher than that of the second holes 5*a*. Preferably, the size of the meshes 6*b* may range between 60 and 100 mesh. During dyeing, as illustrated in FIG. 2, the dyeing liquid flows through the first holes 4*a* of the inner tube 4, the second holes 5*a* of the outer tube 5, and then the meshes 6*b* of the net 6. Thus liquid flow is distributed uniformally throughout the cylindrical body 2 between the opposed flanges 3, 3 so that the liquid can penetrate uniformly throughout the roll of the textile materials T on the net 6, making the textile materials T dyed homogeneously and uniformly without different shades and hues either radially or axially of the roll.

Figure 5:
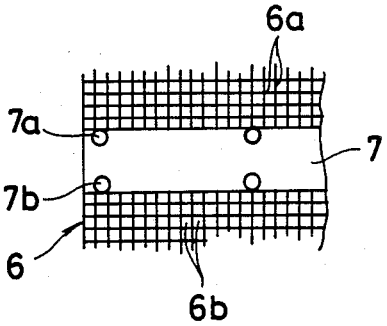
FIG. 5 is an enlarged view showing a portion A of FIG. 1.

As shown in FIGS. 1, 4 and 5, the net 6 is in the form of a sheet with opposite ends interconnected by a connection strip 7 of a material, preferably stainless steel, which is resistant to heat and corrosion. The connection strip 7 has an arcuate cross section with a radius of curvature substantially equal to that of the net 6, making the textile materials T free from being marked with unsightly traces of the connector strip 7. Each end of the net 6 is spot welded to a respective one of opposite longitudinal marginal portions of the connector strip 7 at longitudinal intervals. Such spot-welded portions *7a* of one end of the net 6 are circumferentially aligned with corresponding spot-welded portions *7b* of the other end of the net 6 across the connector strip 7, preventing the net 6 not just from being raised but also from becoming wavy.

In the beam 1, the liquid flow is subdivided gradually as it passes through the first holes 4*a* of the inner tube 4, the second holes 5*a* of the outer tube 5 and then the meshes 6*b* of the net 6 during dyeing. The liquid flow is thus equalized both in flow speed and pressure throughout the cylindrical body 2 between the opposed flanges 3, 3 so that the liquid penetrates in virtually perfect condition through the roll of the textile materials T on the net 6. Accordingly it is possible to make a uniform treatment throughout the roll of the textile materials T without creating different shades and hues either radially or axially of the roll, irrespective of the kind of the textile materials T.

Another advantage of the beam 1 is that because the textile materials T to be treated are wound on the net 6 rather than directly on a perforated tube (prior art), the resultant textile materials T are free from being marked with unsightly traces of holes in or projections on the tube.

Further, since the net 6 is composed of stainless steel wires which are resistant to heat, scale and corrosion which would contaminate the dyeing liquid, the same net 6 can be used repeatedly semi-permanently, not requiring replacement of the net with a new one upon each and every use. Accordingly the troublesome disposal of the non-reusable nets is avoided.

Although various minor modifications may be suggested by those versed in the art, it should be understood that we wish to embody within the scope of the patent warranted hereon, all such embodiments as reasonably and properly come within the scope of our contribution to the art.

What is claimed is:

1. A beam for winding thereon materials to be treated with dyeing liquid, comprising:

(a) an inner tube having a multiplicity of first peripheral holes therethrough and adapted to be connected to a source of dyeing liquid;

(b) an outer tube having a multiplicity of second peripheral holes therethrough and mounted on said inner tube concentrically therewith in radially spaced relation, said second holes being smaller in size and larger in number per unit area than said first holes;

(c) a woven screen fixedly encircling and engaging directly throughout the entire peripheral surface thereof said outer tube, and having a multiplicity of meshes smaller in size and larger in number per unit area than said second holes, said screen comprising a material that is resistant to heat and corrosion;

(d) a separate connector strip; and (e) said screen being in the form of a sheet with non-overlapping opposite ends interconnected by said connector strip in an endwisely opposing relation with the latter.

2. A beam according to claim 1, said separate connector strip comprising a material that is resistant to heat and corrosion.

3. A beam according to claim 1, said material of said separate connector strip comprising stainless steel.

4. A beam according to claim 1, each of said opposite ends of said screen being spot-welded to a respective one of opposite longitudinal marginal portions of said separate connector strip at longitudinal intervals.

5. A beam according to claim 4, such spot-welded portins of one end of said screen being circumferentially aligned with corresponding spot-welded portions of the other end of said screen across said separate connector strip.

* * * * *